United States Patent [19]

Katsumata et al.

[11] Patent Number: 4,855,106

[45] Date of Patent: Aug. 8, 1989

[54] LOW ALLOY STEELS FOR USE IN PRESSURE VESSEL

[75] Inventors: Masaaki Katsumata, Kobe; Isamu Takagi; Eiji Takahashi, both of Hyogo; Tadamichi Sakai, Kobe; Yoji Matsumoto; Hideaki Ohtsu, both of Hyogo; Hiroyuki Uchida, Kobe; Kiyoshi Asami, Hyogo, all of Japan

[73] Assignee: Kabushiki Kaisha Kobe Seiko Sho, Kobe, Japan

[21] Appl. No.: 96,798

[22] Filed: Sep. 15, 1987

Related U.S. Application Data

[63] Continuation of Ser. No. 883,424, Jul. 14, 1986, abandoned, which is a continuation of Ser. No. 704,853, Feb. 25, 1985, abandoned.

[30] Foreign Application Priority Data

Feb. 29, 1984 [JP] Japan ..... 59-39628

[51] Int. Cl.[4] ..... C22C 38/24

[52] U.S. Cl. ..... 420/109; 420/110; 420/111

[58] Field of Search ..... 420/109, 110, 111, 127; 148/334, 335

[56] References Cited

U.S. PATENT DOCUMENTS

| | | | |
|---|---|---|---|
| 3,291,655 | 12/1966 | Gill et al. | 420/110 |
| 4,381,940 | 5/1983 | Watanabe et al. | 420/109 |
| 4,461,657 | 7/1984 | Rana et al. | 420/111 |

FOREIGN PATENT DOCUMENTS

| | | |
|---|---|---|
| 584495 | 10/1959 | Canada . |
| 923735 | 4/1973 | Canada . |

*Primary Examiner*—Deborah Yee

*Attorney, Agent, or Firm*—Oblon, Spivak, McClelland, Maier & Neustadt

[57] ABSTRACT

Low alloy steels for use in pressure vessel comprising on the weight % basis:

C: from 0.05% to 0.30%,

Si: less than 0.10%,

Mn: from 0.3% to 1.5%,

Ni: from inevitably incorporated content to 0.55%,

Cr: from 1.5% to 5.5%,

Mo: from 0.25% to 1.5%,

V: in excess of 0.10% and less than 0.6%, and the balance of iron and inevitably incorporated impurities.

The steels are excellent in hardenability, the hot strength, toughness weldability and hydrogen attack and embrittlement resistance, as well as show excellent toughness after the use in the temper brittle temperature region.

8 Claims, 2 Drawing Sheets

LOW ALLOY STEELS FOR USE IN PRESSURE VESSEL

This application is a continuation of application Ser. No. 883,424, filed on July 14, 1986, which is a continuation of application Ser. No. 704,853, filed Feb. 25, 1985, both now abandoned.

BACKGROUND OF THE INVENTION

1. Field of the Invention

This invention concerns low alloy steels for use in pressure vessel and, more specifically, it relates to Cr-Mo low alloy steels which are excellent in hardenability, hot strength, toughness, weldability and hydrogen attack and embrittlement resistance, as well as have excellent toughness even after the use in the temper brittle temperature region and, accordingly, are suitable to pressure vessel such as coal liquefying apparatus used in a hydrogen atmosphere under high temperature and high pressure.

2. Description of the Prior Art

Cr-Mo steels have hitherto been employed generally for pressure vessel such as in petroleum refining facilities used in the hydrogen atmosphere under high temperature and high pressure. By the way, new energy sources have recently been looked for as the substitutes for petroleum and study and experiment have been made, for example, on coal liquefication. In the case of coal liquefication, however, since the reaction is taken place under high temperature and pressure as compared with the conventional petroleum refining, reaction vessels used therefor have to satisfy the requirement for higher creep strength. Further, as the pressure vessel have become larger in the scale and increased in the thickness from the economical point of view, they tend to reduce the cooling rate and increase the time for post weld heat treatment thus making it difficult to provide steel materials with great hot strength. In addition, inevitable increase has been imposed to the material cost, and production or transportation cost due to the increase in the weight of the steel materials. Further, since the operation condition in the coal liquefication, for example, that of the temperature which is higher than 450° C. corresponds to so-called the temper brittle temperature region, the toughness of the steels is degraded during use.

In order to overcome the foregoing problems, there have been proposed low alloy steels for use in pressure vessel, for instance, in Japanese Patent Publication No. 57946/1982 (Kokai 57-57946), in which the sulfur content is decreased to improve the toughness and the silicon content is decreased to suppress the sensitivity to embrittlement in Cr-Mo steels and, further, vanadium and niobium contents are added to compensate the reduction in the hot strength caused by the decrease in the silicon content. However, even these proposed steels have no sufficient hot strength and creep strength.

OBJECT OF THE INVENTION

Accordingly, it is an object of this invention to provide low alloy steels for use in pressure vessel which are excellent in the hardenability and the toughness.

Another object of this invention is to provide low alloy steels for use in pressure vessel which are improved in the hot strength and the creep strength.

SUMMARY OF THE INVENTION

The present inventors have made an earnest study for overcoming the foregoing problems in the prior art and attained this invention based on the finding that the toughness of steel materials can be improved by decreasing the silicon content while ensuring the hardenability by increasing the addition amount of manganese and, optionally, nickel and that the hot strength and the creep strength can significantly be improved by the addition of at least one element selected from niobium and titanium in combination with vanadium.

As the main feature, the low alloy steels for use in pressure vessel according to this invention comprises on the weight % basis:

C : from 0.05 % to 0.30 %
Si : less than 0.10 %
Mn : from 0.3 % to 1.5 %
Ni : from inevitably incorporated content to 0.55 %
Cr : from 1.5 % to 5.5 %
Mo : from 0.25 % to 1.5 %
V : in excess of 0.10 % and less than 0.6 %, and the balance of iron and inevitably incorporated impurities.

BRIEF DESCRIPTION OF THE ACCOMPANYING DRAWINGS

These and other objects, as well as the features of this invention will be made apparent from the detailed descriptions of the invention in conjunction with the accompanying drawings, wherein FIG. 1 is a diagram showing the relationship between the V content and the mechanical property in the steels according to this invention, and FIG. 2 is a diagram showing the creep strength of the steels according to this invention and of the conventional steels in comparison.

DETAILED DESCRIPTION OF THE INVENTION

Description will at first be made to the reason in definiting the amount of alloying elements added to the steel materials according to this invention.

Carbon (C) has to be added at least by 0.05 % for securing the strength of the steel materials. However, since excess addition results in the degradation for the toughness and the weldability, the upper limit for the addition amount is defined as 0.30 %.

Manganese (Mn) has to be added by more than 0.5 % for securing the hardenability of the steel material, and it also contributes to the improvement in the resistance to stress relief cracks (SR crack resistance). However, its upper limit is defined as 1.5 % since excess Mn addition over 1.5 % reduces the hot strength, increase the sensitivity to the temperature embrittlement and further degrades the weldability.

Nickel (Ni) is usually contained by a trace amount in the steels as inevitable impurities. In this invention, nickel may positively be added for improving the toughness and the hardenability of the steels. The upper limit for the Ni addition is defined as 0.55 % since the addition in excess of the above-defined limit reduces the creep strength.

Chromium (Cr) is added at least by 1.5 % for providing the steel materials with the resistance to oxidation and hydrogen attack. If the Cr content is less than the above level, neither the intended effect nor sufficient hot strength can be obtained. On the other hand, since excess Cr addition leads to the degradation in the weldability and the workability, the upper limit is defined as 5.5 %.

Molybdenum (Mo) is an element effective to the significant improvement in the hot strength of the steel materials and also the improvement in the resistance to the hydrogen attack and embrittlement. In this invention, Mo is added by more than 0.25 % in order to obtain such effects substantially. However, since excess Mo addition reduces the weldability and increases the material cost, the upper limit is defined as 1.5 %.

Vanadium (V) is an essential alloying element in the steels according to this invention for improving the cold and hot strength of the steels due to its function of forming carbides and nitrides. V is added in excess of 1.0 % and less than 0.6 % in this invention, but more preferably in excess of 0.25% and less than 0.5%. Vanadium in excess of 0.3% and less than 0.6% is also preferred.

Figure 1:
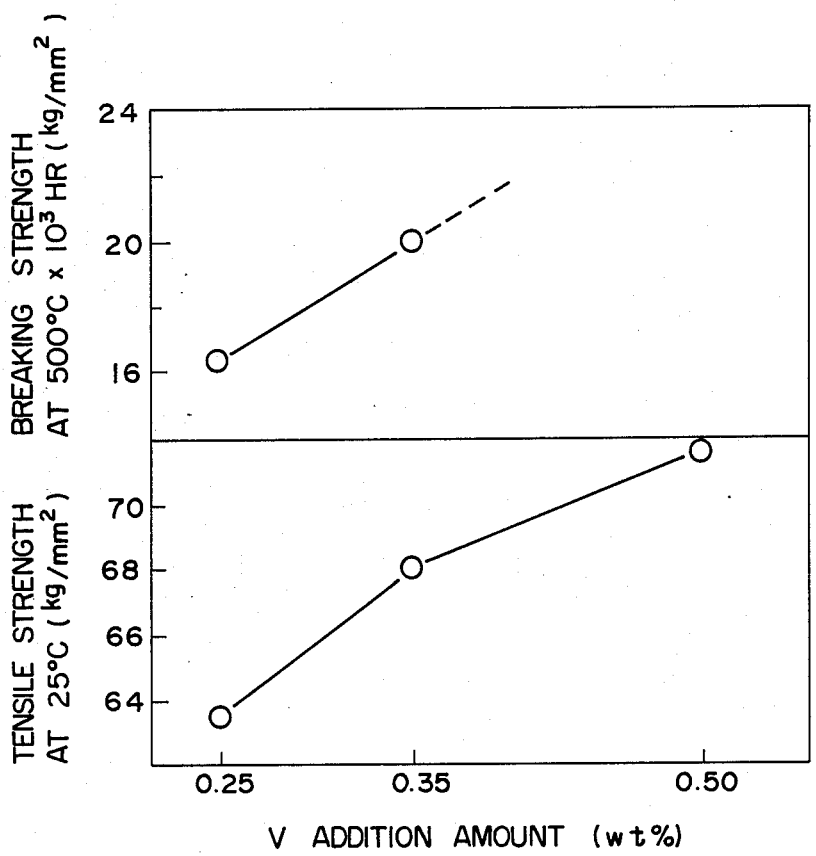

FIG. 1 shows the tensile strength (at 25° C.) and the rupture strength of the steels according to this invention when heated at 500° C. for 1000 hours while varying the addition amount of V. It will be apparent from the figure that the cold strength and the hot strength can remarkably be improved, particularly upon adding V by more than 0.2 %. If the addition amount of vanadium is lower than 0.10 % only an insufficient improvement can be attained in the creep strength and the hot strength of the steels. On the other hand, addition of vanadium in excess of 0.6 % is neither desired since this degrades the toughness and the weldability of the steels. More preferably, vanadium is added in excess of 0.25% and less than 0.5% when considering creep strength and hydrogen attack and embrittlement.

In the steel materials according to this invention, it is possible, in addition to the elements as described above, to incorporate at least one ingredients selected from:

(i) from 0.01 % to 0.6 % of at least one element selected from Nb and Ti in total, (ii) from 0.0005 % to 0.02 % of at least one element selected from Ca and Zr in total and/or from 0.01 % to 0.20 % of at least one of rare earth elements, and (iii) from 0.0005 % to 0.002 % B.

Niobium (Nb) and titanium (Ti), like vanadium, form carbides and nitrides to significantly increase the cold strength and the hot strength of the steel materials. As described above, addition of at least one of them in combination with vanadium can significantly improve the cold strength and the hot strength of the steel materials. In the steels according to this invention, at least one element selected from Nb and Ti can be added in a range between 0.01 % - 0.6 %. However, excess addition thereof degrades the toughness and the weldability of the steels.

Figure 2:
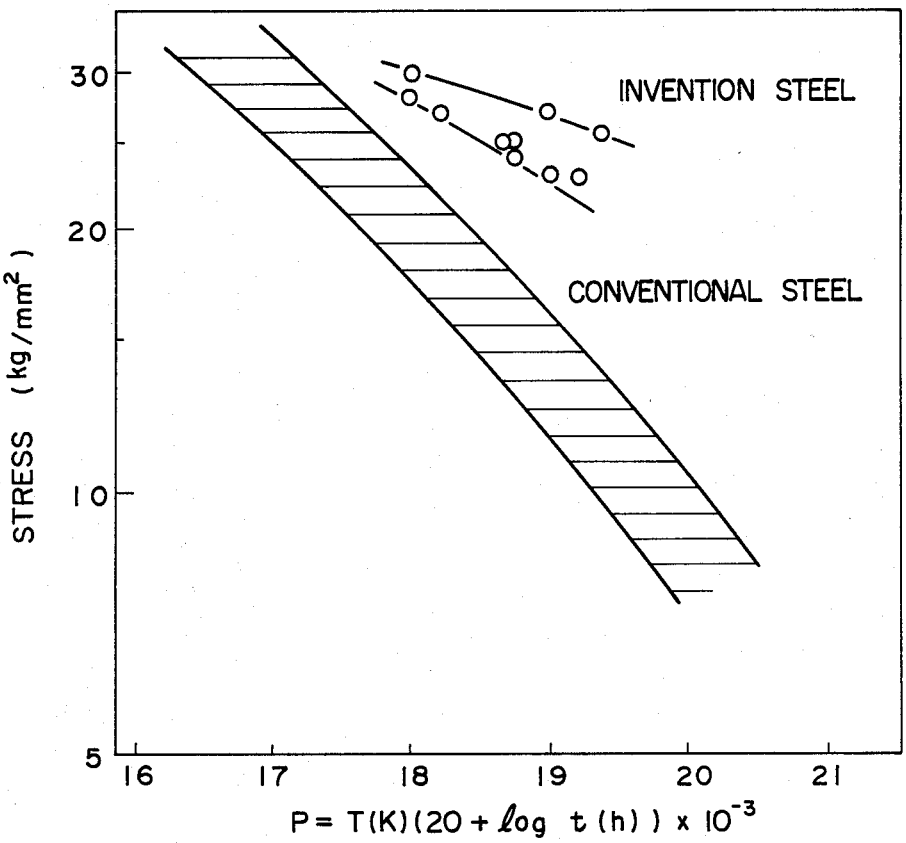

FIG. 2 shows the creep strength of the steels according to this invention having the chemical compositions shown in steel Nos. 21–23 and that of SA336F2 which is a typical example of conventional Cr-Mo steels shown in Table 1 below.

TABLE 1

| Steel | Chemical composition (wt %) | | | | | | | | | |
|---|---|---|---|---|---|---|---|---|---|---|
| No. | C | Si | Mn | Ni | Cr | Mo | V | etc. | | Remarks |
| 1 | 0.14 | 0.23 | 0.45 | 0.10 | 2.20 | 1.02 | — | — | | Conventional |
| 2 | 0.14 | 0.07 | 0.47 | 0.08 | 2.88 | 0.97 | — | — | | steels |
| 3 | 0.15 | 0.08 | 0.46 | 0.07 | 2.89 | 0.99 | 0.25 | — | | Comparative |
| 4 | 0.14 | 0.06 | 0.49 | 0.73 | 2.98 | 0.95 | 0.23 | — | | steels |
| 5 | 0.14 | 0.07 | 0.55 | 0.40 | 2.98 | 1.00 | 0.24 | — | | Invented |
| 6 | 0.14 | 0.07 | 0.74 | 0.07 | 3.02 | 1.00 | 0.25 | — | | steels |
| 7 | 0.14 | 0.08 | 1.26 | 0.07 | 3.05 | 0.93 | 0.27 | — | | |
| 8 | 0.13 | 0.09 | 0.92 | 0.20 | 2.98 | 0.97 | 0.39 | — | | |
| 9 | 0.14 | 0.08 | 0.98 | 0.18 | 3.01 | 1.04 | 0.26 | Nb: 0.08 | | |
| 10 | 0.14 | 0.07 | 1.00 | 0.09 | 3.04 | 0.98 | 0.25 | Nb 0.01 | Ti 0.03 | |
| 11 | 0.14 | 0.05 | 1.03 | 0.07 | 3.00 | 0.98 | 0.22 | Ti: 0.04 | | |
| 12 | 0.15 | 0.07 | 1.01 | 0.20 | 2.99 | 1.03 | 0.34 | Ca: 0.0037 | | |
| 13 | 0.14 | 0.07 | 1.04 | 0.10 | 3.00 | 1.00 | 0.35 | Ca 0.0040 | Ce 0.030 | |
| 14 | 0.15 | 0.08 | 0.98 | 0.09 | 3.02 | 0.97 | 0.34 | Ca 0.0040 | Zr 0.018 | |
| 15 | 0.14 | 0.07 | 0.93 | 0.18 | 3.02 | 0.95 | 0.48 | Zr: 0.058 | | |
| 16 | 0.14 | 0.08 | 1.02 | 0.15 | 2.95 | 0.98 | 0.25 | B: 002 | | |
| 17 | 0.14 | 0.07 | 1.02 | 0.10 | 3.01 | 0.98 | 0.25 | Ca 0.0040 | B 0.0018 | |
| 18 | 0.13 | 0.07 | 0.98 | 0.07 | 3.02 | 0.97 | 0.24 | Zr 0.018 | B 0.0020 | |
| 19 | 0.14 | 0.07 | 0.99 | 0.07 | 2.98 | 0.99 | 0.23 | Ce 0.030 | B 0.0015 | |
| 21 | 0.14 | 0.07 | 1.04 | 0.07 | 2.91 | 1.01 | 0.26 | Nb: 0.07 | Ca: 0.0044 | |
| 20 | 0.14 | 0.08 | 0.82 | 0.10 | 2.56 | 0.93 | 0.26 | Ca: 0.0035 | | |
| 22 | 0.14 | 0.07 | 0.70 | 0.30 | 2.99 | 0.99 | 0.25 | Nb: 0.05 | Ca: 0.0045 | |
| 23 | 0.13 | 0.054 | 0.82 | — | 3.01 | 0.99 | 0.29 | Nb: 0.057 | Ca: 0.0050 | |

The steels according to this invention have extremely high creep strength, as well as much higher hot strength as compared with that of the conventional steels and comparative steels at the same level of the cold strength and, accordingly, the invented steels are practically superior.

Calcium (Ca), Zirconium (Zr) and rare earth elements, being sulfide-forming elements, can significantly reduce the sensitivity of steels to the welding cracks by decreasing the solid-soluted sulfur content in the steels. In order to effectively attain this effect, at least one of Ca and Zr has to be added within a range of 0.005 %–0.02 % in total. While on the other hand,the rare earth element is added within a desired range of 0.01 %–0.2 %. However, if these elements are added in excess of the above defined ranges, the purify of the steels becomes poor and the toughness is reduced.

Boron (B) is added for improving the hardenability of the steels. According to this invention, this improvement can be attained effectively by boron alone without using titanium together. A preferred range for the addition of boron is between 0.0005 %–0.02 %.

The steels according to this invention can be manufactured by conventional procedures of melting, ingot preparation and hot rolling, and by applying conventional heat treatment subsequently or continuously thereto.

In the steels according to this invention, the toughness can be improved by decreasing the Si content while securing the hardenability by increasing the addition amount of manganese and, optionally, nickel, as well as the hot strength and the creep strength can significantly be improved by adding vanadium together with at least one element preferably selected from niobium and titanium. Further, since the steels according to this invention have excellent resistance to the hydrogen attack and embrittlement and the weldability, as well as have excellent toughness after the use in the temper brittle temperature regin, they are suitable as the steel materials for use in pressure vessel used in hydrogen atmosphere under the high temperature and high presssure.

This invention will now be described referring to Examples.

EXAMPLE

After melting steels having chemical compositions respectively as shown in Table 1 in an induction vacuum furnace into steel ingots, they were forged and rolled to steel sheets. Then, they were subjected to austenizing at 950°-1050° C., cooling at an average cooling rate of 10° C./sec., tempering at 675° C., and then applied with an after heat treatment through by heating at 690° C. for 25 hours. The mechanical properties and the weldability of the steels according to this invention, conventional steels and comparative steels are shown in Table 2.

TABLE 2

| Steel No. | K f(1) (°C./ ) | Tensile strength at room temp. (kg/mm²) | Tensile strength at 550° C. (kg/mm²) | Creep(2) strength (kg/mm²) | vTrs(3) (°C.) | ΔvTrs(4) (°C.) | SR cracking(5) rate (%) | TRC lower(6) limit stress (kg/mm²) | Remarks |
|---|---|---|---|---|---|---|---|---|---|
| 1 | 8.5 | 60.4 | 40.5 | 15.8 | −35 | 15 | 20 | 15 | Conventional steels |
| 2 | 4.5 | 60.2 | 40.3 | 15.5 | −35 | 13 | 15 | 16 | |
| 3 | 30.0 | 61.2 | 42.1 | 17.0 | −35 | 15 | 15 | 14 | Comparative steels |
| 4 | 0.8 | 65.2 | 43.3 | 16.0 | −48 | 10 | 12 | 16 | |
| 5 | 1.8 | 65.0 | 43.8 | 17.0 | −55 | 10 | 0 | 18 | Invented steels |
| 6 | 7.0 | 63.9 | 43.8 | 17.0 | −66 | 8 | 0 | 20 | |
| 7 | 0.23 | 64.1 | 44.4 | 17.5 | −60 | 13 | 0 | 23 | |
| 8 | 1.95 | 68.6 | 44.0 | 22.0 | −73 | 10 | 22 | 18 | |
| 9 | 5.0 | 65.3 | 47.9 | 24.55 | −45 | 12 | 15 | 18 | |
| 10 | 7.0 | 67.2 | 47.0 | 24.7 | −33 | 10 | 15 | 7 | |
| 11 | 6.0 | 70.2 | 48.2 | 25.0 | −35 | 15 | 10 | 18 | |
| 12 | 1.6 | 68.1 | 46.6 | 20.1 | −44 | 10 | 0 | 20 | |
| 13 | 1.8 | 68.4 | 46.2 | 20.3 | −50 | 8 | 0 | 22 | |
| 14 | 1.7 | 68.2 | 46.0 | 20.8 | −52 | 7 | 0 | 21 | |
| 15 | 2.0 | 71.6 | 44.3 | 24.3 | −70 | 12 | 0 | 20 | |
| 16 | 2.0 | 63.5 | 45.1 | 19.0 | −48 | 5 | 15 | 18 | |
| 17 | 2.2 | 64.0 | 45.0 | 19.5 | −55 | 7 | 0 | 20 | |
| 18 | 2.4 | 63.0 | 44.8 | 20.1 | −58 | 6 | 0 | 22 | |
| 19 | 2.3 | 63.3 | 44.8 | 19.4 | −57 | 5 | 0 | 21 | |
| 21 | 5.0 | 65.1 | 48.2 | 27.4 | −49 | 9 | 0 | 20 | |
| 20 | 0.30 | 65.9 | 44.4 | 17.4 | −65 | 10 | 0 | 20 | |
| 22 | 4.0 | 68.4 | 46.0 | 23.0 | −73 | 9 | 0 | 19 | |
| 23 | 6.0 | 68.0 | 45.5 | 24.0 | −48 | 5 | 0 | 20 | |

(1)Critical cooling rate forming initial ferrite deposition
(2)550° C. × $10^3$ hr
(3)Transition temperature at Charpy 50% brittle broken face
(4)vTrs rising amount by step cooling treatment
(5)Orthogonal Y-type weld crack test
(6)TRC test Steels Nos. 1 and 2 as the typical examples of conventional Cr-Mo steels are inferior in the cold strength, the hot strength and the toughness. Steels No. 3 as the comparative steels with the Mn content lower than the range as specified in this invention is poor in the hardenability. Steels No. 4 with an excess Ni content has no improved creep strength.

Steels No. 5 through No. 23 represents those according to this invention. It is recognized that the steels according to this invention are generally excellent in the cold strength, the hot strength and the creep strength. Steels No. 8 having a somewhat higher V content are inferior to other steels according to this invention but still comparable with the conventional steels, with regard to the weldability. While on the other hand, the hot strength and the creep strength are significantly improved in the steels No. 8. Steels Nos. 9, 10, 11 and 20 containing at least one element selected from Nb and Ti added in combination with V show remarkably improved hot strength and creep strength.

Steels No. 16 containing B show improved hot strength and creep strength. Further, the steels according to this invention, in which Ca, Zr and/or Ce are added show a remarkable improvement in the weldability in addition to the hot strength and the creep strength.

Although not shown in the examples, sulfur(S) should preferably be suppressed not more than 0.01% so as not to cause hydrogen embrittlement or hydrogen induced cracking.

What is claimed is:

1. A low alloy steel for use in a pressure vessel consisting essentially of on a weight % basis:

C: from 0.05% to 0.20%,
Si: less than 0.10%,
Mn: from 0.3% to 1.5%,
Ni: from a trace impurity level to 0.55%,
Cr: from 1.5% to 5.5%,
Mo: from 0.5% to 1.5%,
V: in excess of 0.3% and less than 0.6%,
Nb: from 0.05% to 0.08%,
Ca: from 0.0005% to 0.02%, and
the balance of iron and inevitably incorporated impurities.

2. The alloy steel of claim 1, further comprising Zr satisfying the relationship of $0.0005\% \leqq (Ca+Zr) \leqq 0.02\%$.

3. The alloy steel of claim 1, further comprising at least one rare earth element in an amount of from 0.01% to 0.02%.

4. The alloy steel of claim 1, wherein V is present in an amount of in excess of 0.3% to 0.05%.

5. A low alloy steel for use in a pressure vessel consisting essentially of on a weight % basis:

C: from 0.05% to 0.20%,
Si: less than 0.10%,
Mn: from 0.3% to 1.5%,
Ni: from a trace impurity level to 0.55%,
Cr: from 1.5% to 5.5%,
Mo: from 0.5% to 1.5%,
V: from 0.34% to less than 0.6%,
Nb: from 0.05% to 0.08%,
Ca: from 0.0005% to 0.02%, and
the balance of iron and inevitably incorporated impurities.

6. The alloy steel of claim 5, further comprising Zr satisfying the relationship of $0.0005\% \leqq (Ca+Zr) \leqq 0.02\%$.

7. The alloy steel of claim 5, further comprising at least one rare earth element in an amount of from 0.01% to 0.02%.

8. The alloy steel of claim 5, wherein V is present in an amount of 0.34% to 0.5%.

* * * * *